United States Patent [19]

Miller

[11] 3,945,139

[45] Mar. 23, 1976

[54] ADVERTISING DEVICE

[76] Inventor: Robert A. Miller, 142 Harbor View, Lake St. Louis, Mo. 63367

[22] Filed: July 24, 1975

[21] Appl. No.: 598,696

Related U.S. Application Data

[63] Continuation-in-part of Ser. No. 442,735, Feb. 15, 1974, abandoned.

[52] U.S. Cl. ..... 40/130 R; 40/126 B; 46/228; 272/8 R; 335/205

[51] Int. Cl.[2] ..... G09F 13/00

[58] Field of Search ..... 40/130 R, 130 L, 132 R, 40/126 B; 46/228, 231; 272/8 R, 8 N, 8 D; 240/10.6 R, 10.66; 335/205

[56] References Cited

UNITED STATES PATENTS

| | | | |
|---|---|---|---|
| 2,619,349 | 11/1952 | Abrahamson | 272/8 R X |
| 3,223,412 | 12/1965 | Freeman et al. | 272/8 R |
| 3,292,287 | 12/1966 | Marn | 40/126 B X |
| 3,463,491 | 8/1969 | Shaw | 335/206 X |
| 3,479,561 | 11/1969 | Janning | 272/8 N X |
| 3,621,417 | 11/1971 | Halaby | 335/205 |
| 3,696,548 | 10/1972 | Teller | 46/228 |

*Primary Examiner*—Louis G. Mancene
*Assistant Examiner*—John F. Pitrelli

[57] ABSTRACT

An advertising device is provided which includes a base and a display piece. The base has a display piece supporting surface and a magnet concealed beneath the surface. The display piece, which is of a size and weight to permit easy handling and carries advertising indicia, has a lamp, an electric battery and a reed switch, all connected in series with one another, encapsulated within the piece. The outer surface of the piece is smooth and uninterrupted and at least the battery and reed switch are concealed from view. The reed switch is positioned wholly within the display piece and physically isolated from the base surface when the piece is resting on the surface, but exposed to a magnetic field of the magnet in at least one position of the piece on the base surface, to change the position of the reed switch contact reeds relative to one another, either to close the circuit through the lamp to light the lamp, or to open the circuit to extinguish the lamp. Preferably, transformer and rectifying means by which the battery can be recharged are also encapsulated within the piece.

3 Claims, 7 Drawing Figures

ADVERTISING DEVICE

CROSS REFERENCE TO RELATED APPLICATION

This application is a continuation-in-part of application Ser. No. 442,735, filed Feb. 15, 1974, now abandoned.

BACKGROUND OF THE INVENTION

The function of an advertising device is to attract the attention of potential customers, preferably to keep that attention and to direct and redirect the attention to the product or service which is being advertised. An advertising piece which not only attracts attention but invites repeated handling is particularly effective.

One of the objects of this invention is to provide an advertising device which attracts attention, piques the imagination and invites repeated handling.

Other objects will become apparent to those skilled in the art in light of the following description and accompanying drawings.

SUMMARY OF THE INVENTION

In accordance with this invention generally stated, an advertising device is provided comprising a base and a manipulable display piece, the base having a display piece supporting surface and a magnet concealed beneath the surface. The display piece, which bears advertising indicia, contains, encapsulated wholly within it, a lamp, an electric battery, and a reed switch all connected in series with one another, the reed switch being positioned within the piece to be physically isolated from the base surface when the piece is resting on the surface but to be exposed to a magnetic field of the base magnet in at least one position of the piece on the base surface, whereby the position of the reed switch contact reeds relative to one another is changed in response to the magnetic field. The outer surface of the piece is smooth and uninterrupted and at least the battery and reed switch are concealed from view. In the preferred embodiment, transformer and rectifying means by which the battery can be recharged are also encapsulated within the piece, and are also concealed from view.

DESCRIPTION OF THE PREFERRED EMBODIMENT

Figure 1:
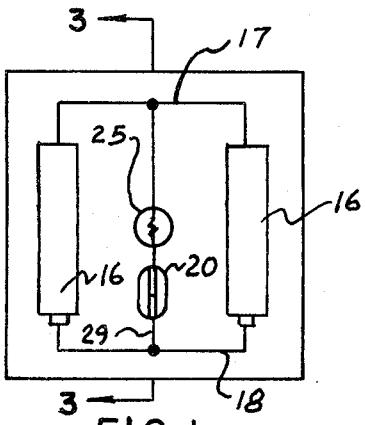
FIG. 1 is a bottom plan view of an illustrative example of display piece of this invention.

Referring now to the drawings for one illustrative embodiment of advertising device of this invention, the device is made up of a base 1 and a display piece 10.

The base 1, in the illustrative embodiment shown, is square, with a flat bottom 2, beveled sides 3 and a display piece supporting top surface 4. In the embodiment shown, the base is made of any suitable non-magnetic material such as plastic or wood, and has embedded within it near but below the supporting top surface 4 and parallel with the surface, a bar magnet 5 with a North pole 6 and a South pole 7. In this embodiment the bar magnet 5 is positioned symmetrically in the center of the supporting top surface 4.

The display piece 10 is shown for purposes of illustration as being square in plan and pyramidal in side elevation with a flat bottom surface 11 and four triangular sides 12 upon which advertising indicia 13 are displayed. The term "advertising indicia" is used broadly to encompass not only words, designs and illustrations, formed in or on the surface of the piece, carried by the surface of the piece, or embedded in the piece, but to encompass the shape of the display piece itself. For example, the display piece can be in the form of a well known bottle shape.

Figure 2:
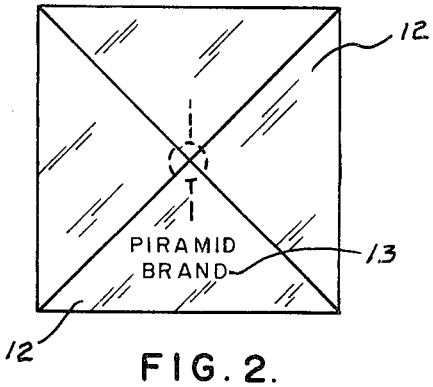
FIG. 2 is a top plan view of the display piece of FIG. 1.
Figure 3:
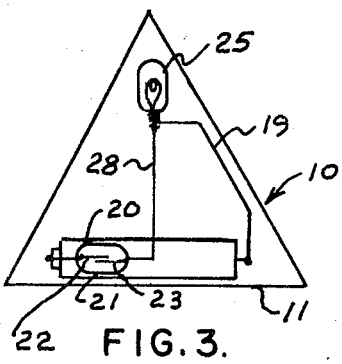
FIG. 3 is a sectional view taken along the line 3—3 of FIG. 1.
Figure 4:
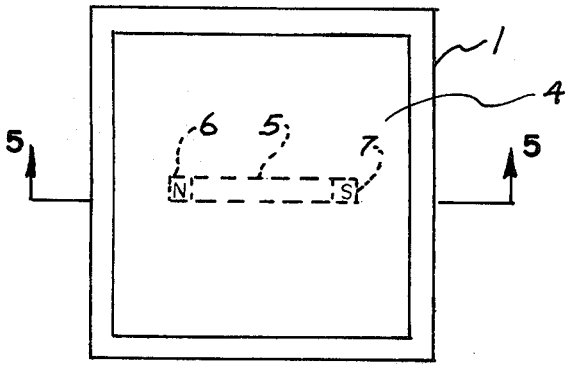
FIG. 4 is a top plan of an illustrative example of base of this invention.
Figure 5:
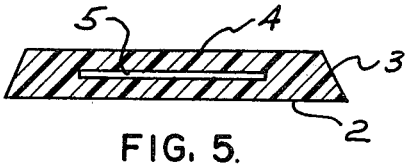
FIG. 5 is a sectional view taken along the line 5—5 of FIG. 4.

In the illustrative embodiment shown, for the sake of clarity of description, in the FIGS. 1 and 3 the display piece 10 is shown as being made of transparent plastic. In fact, as indicated in FIG. 2, the device is intended to be made in such a way that at least the battery and reed switch, and in the embodiment in which a recharging circuit is supplied, the recharging circuit, are concealed from view, either by an opaque insert, which may form a part of the advertising indicia, such as a miniature beer can or other package, or by use of an obscuring pigment or dye. Embedded within the solid plastic matrix are elements of an electrical circuit 15, consisting of batteries 16 connected in parallel by conductors 17 and 18, a reed switch 20, which includes an envelope 21 and contact reeds 22 and 23, and a lamp 25 with a filament 26. One side of the filament 26 is electrically connected to the conductor 18 by means of a conductor 19. The other side of the filament is electrically connected to the contact reed 23 by means of an electrical conductor 28. The other contact reed 22 is electrically connected to the conductor 17 by means of a conductor 29.

In the embodiment of display piece shown, the reed switch 20 is of the type in which the contact reeds 22 and 23 are normally biased apart, so that the circuit 15 is open and the lamp 25 extinguished. It will be observed that the reed switch 20 is positioned on a center line between two of the sides, parallel with and near the bottom 11, but is offset from the center of the bottom. Thus, the reed switch 20 will be positioned directly over one of the poles of the bar magnet 5 in two positions, 180° apart, on the supporting top surface 4 of the base when the bottom 11 of the piece is positioned squarely on the supporting top surface 4, and will be at a point remote from and midway between the poles 6 and 7 of the magnet when the piece is oriented 90° from the other positions.

The reed switch 20 can be of the type in which the contact reeds move to circuit closing position in response to the magnetic field of either polarity, or of only one polarity. In the former case, the reed switch will close, and the circuit will be completed in two of four positions of the piece squarely on the base. In the latter, the contact reeds will close the circuit in only one position. In any event, the contact reeds will move apart, to open the circuit and extinguish the lamp when the display piece is lifted from the base.

The reed switch can be of the type in which the contact reeds are normally biased to the closed position and move apart in response to a magnetic field of one or the other polarity or both. In this event, the lamp will be energized whenever the display piece is removed from the base, and will be extinguished only when the display piece is placed in the proper orientation upon the base.

The reed switch 20 can also be of the remanent type, responding to a magnetic field of one polarity to close and remaining closed until exposed to a magnetic field of the opposite polarity, at which time it opens and remains open until again exposed to the magnetic field of the "closing" polarity. In this event, the lamp will be energized in one position of the piece on the support surface and remain energized even when removed from the base, until it is placed upon the support surface 180° from its initial orientation.

It is evident that the display piece is made in such a way that the light from the lamp is manifest when the lamp is energized. The battery (which term is used to indicate any number of individual units) and reed switch are concealed from view, preferably, in the normally exposed areas of the piece, by the advertising indicia themselves or the background for the advertising indicia, both of which are hereinafter embraced within the term advertising indicia. The display piece should be of such size, shape and heft as to invite its being picked up and handled.

The base can be of any desired shape and can also carry advertising indicia. The display piece supporting surface preferably is well defined, as by a bounding rim, or by the shape and size of the supporting area of the base to facilitate the display piece's being placed squarely on it.

Figure 6:
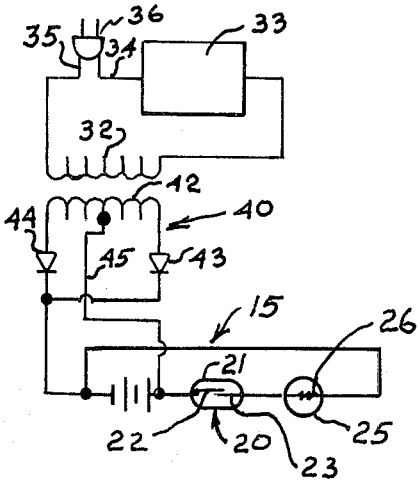
FIG. 6 is a circuit diagram of the electrical circuit within the display piece of FIG. 1.

While the advertising device will fulfill its function by lasting for the duration of life of the battery, the battery can be of the rechargable type. For purposes of recharging, the display piece circuit can include one or more diodes and a loop or coil constituting the secondary of a transformer, the primary loop or coil of which can be in a recharging base, connected to a source of alternating current. Such a circuit is illustrated in FIG. 6, and a recharging base 30 and elements of a recharging circuit 40 in the piece, in FIG. 7.

Figure 7:
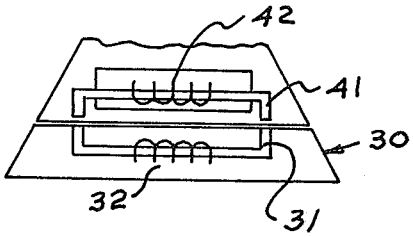
FIG. 7 is a fragmentary, somewhat diagrammatic view in side elevation showing elements of an illustrative embodiment of recharging circuit in a recharging base and piece of this invention.

Referring now to those figures, the recharging base is shown somewhat diagrammatically in FIG. 7 as including a U-shaped core 31 and a primary coil 32. In fact, as shown in FIG. 6, it also can contain a current limiting device 33, and leads 34 and 35 which extend from the base and are electrically connected to an electrical connector 36 adapted for connection to a source of alternating current. A recharging circuit 40, embedded in the piece 10, in the embodiment shown includes a U-shaped core 41, a secondary coil 42, diodes 43 and 44 electrically connected to the ends of the coil 42, and a center tap 45 connected electrically to the coil 42 and to one end of the battery 16. Both diodes 43 and 44 are electrically connected to the other end of the battery 16. The core 41 and coil 42 can be embedded near and parallel to the upper edge of the piece, remote from the switch 20, as viewed in FIG. 1, and the proper orientation indicated in or on the bottom surface of the piece if desired.

Numerous variations in the construction of the device of this invention within the scope of the appended claims will occur to those skilled in the art in light of the foregoing disclosure. Merely by way of illustration, a recharging circuit with a single diode can be employed or, conversely, a charging circuit can be encapsulated which includes an automatic cut off when the battery has become charged, so as to preclude damage to the battery and piece itself. Such circuits are conventional, and examples can be found in the General Electric SCR Manual, among other places. These variations are merely illustrative.

Having thus described the invention, what is claimed and desired to be secured by Letters Patent is:

1. An advertising device comprising a base and a manipulable display piece, said base having a clearly delineated supporting surface and a magnet concealed beneath said surface, said magnet having a pole eccentrically positioned with respect to the center of said delineated supporting surface, and said display piece having a lamp, an electric battery and a reed switch all connected in series with one another and all totally encapsulated within a solid plastic matrix, the outer surface of which is uninterrupted, said reed switch having an envelope and contact reeds within said envelope and movable with respect to one another in response to the presence of a magnetic field at said magnet pole, said reed switch being positioned within said piece to be physically isolated from said base surface when said piece is resting on said surface but to be exposed to said magnetic field for changing the position of the reed switch contact reeds relative to one another in at least one position of the piece on said base, advertising indicia carried by said plastic matrix, and means comprising said advertising indicia for concealing from sight at least said electric battery and reed switch.

2. The device of claim 1 wherein the said battery is rechargable and a recharging circuit, including transformer and rectifier means is totally encapsulated within the said matrix and concealed from sight by the said means for concealing said electric battery and reed switch.

3. An advertising device comprising a base and a manipulable display piece, said base having a supporting surface and a magnet concealed beneath said surface, said display piece having a lamp, a reed switch and a rechargable battery all connected in series with one another and a recharging circuit including a transformer coil and rectifying means electrically connected to said battery, all of said lamp, switch, battery and recharging circuit being totally encapsulated within a solid plastic matrix the outer surface of which is uninterrupted, said reed switch being responsive to a magnetic field of said magnet at at least one position of said display piece on said supporting surface, advertising indicia carried by said plastic matrix, and means comprising said advertising indicia, for concealing from sight at least said electric battery, reed switch and recharging circuit.

* * * * *